US007385368B2

(12) United States Patent
Hong et al.

(10) Patent No.: US 7,385,368 B2
(45) Date of Patent: Jun. 10, 2008

(54) APPARATUS FOR CONTROLLING OPERATION OF RECIPROCATING COMPRESSOR

(75) Inventors: Eon-Pyo Hong, Seoul (KR); Kyeong-Bae Park, Seoul (KR); Tae-Hee Kwak, Incheon (KR); Ki-Chul Choi, Seoul (KR); Sung-Hyun Ki, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 657 days.

(21) Appl. No.: 10/823,596

(22) Filed: Apr. 14, 2004

(65) Prior Publication Data

US 2005/0053471 A1 Mar. 10, 2005

(30) Foreign Application Priority Data

Aug. 14, 2003 (KR) ..... 10-2003-0056510

(51) Int. Cl.
*F04B 49/00* (2006.01)
*H02P 7/00* (2006.01)
*F25B 9/00* (2006.01)

(52) U.S. Cl. ..... 318/434; 318/471; 318/783; 318/798; 417/44.11; 417/44.1; 62/228.1

(58) Field of Classification Search ..... None
See application file for complete search history.

(56) References Cited

U.S. PATENT DOCUMENTS 3,855,129 A 12/1974 Abrahams et al.
4,547,825 A * 10/1985 Vind ..... 361/22
5,212,436 A * 5/1993 Nacewicz et al. ..... 318/788
5,345,126 A * 9/1994 Bunch ..... 310/68 C
6,278,910 B1 8/2001 Miura et al.
6,356,047 B1 * 3/2002 Cecconi ..... 318/791
6,384,558 B2 * 5/2002 Yoshida et al. ..... 318/445
6,456,470 B1 * 9/2002 Cecconi ..... 361/22
6,623,246 B2 9/2003 Hwang et al.
6,644,943 B1 11/2003 Lilie et al.
6,715,301 B2 * 4/2004 Song ..... 62/6
6,747,428 B1 * 6/2004 Kwon et al. ..... 318/434
6,844,698 B1 * 1/2005 Kwon et al. ..... 318/778
7,031,132 B1 * 4/2006 Mitchell ..... 361/103
2004/0080287 A1 * 4/2004 Park ..... 318/124

(Continued)

FOREIGN PATENT DOCUMENTS

DE 2311016 9/1973

(Continued)

OTHER PUBLICATIONS

English Language Abstract of KR 10-2001-0055182.

(Continued)

*Primary Examiner*—Lincoln Donovan
*Assistant Examiner*—Eduardo Colon-Santana
(74) *Attorney, Agent, or Firm*—Greenblum & Bernstein, P.L.C.

(57) ABSTRACT

An apparatus for controlling an operation of a reciprocating compressor includes a inductance increasing device connected to a motor of the reciprocating compressor, so that a surge current generated when power is applied to the reciprocating compressor at an initial stage is reduced and thus an initial stroke of the reciprocating compressor is reduced. Accordingly, operational efficiency of the reciprocating compressor is improved.

3 Claims, 3 Drawing Sheets

U.S. PATENT DOCUMENTS

2005/0271519 A1* 12/2005 Hong et al. ..... 417/44.11
2006/0153688 A1* 7/2006 Lee et al. ..... 417/44.1

FOREIGN PATENT DOCUMENTS

DE 10207511 12/2002
JP 1-103192 4/1989
JP 3-151584 6/1991
JP 09145124 A * 6/1997
KR 10-2001-0055182 7/2001

OTHER PUBLICATIONS

English Language Abstract of JP 3-151584.
English Language Abstract of JP 1-103192.

* cited by examiner

APPARATUS FOR CONTROLLING OPERATION OF RECIPROCATING COMPRESSOR

BACKGROUND OF THE INVENTION

1. Field of the Invention

The present invention relates to a reciprocating compressor, and particularly, to an apparatus for controlling an operation of a reciprocating compressor.

2. Description of the Prior Art

In general, by eliminating the use of a crankshaft for converting a rotary motion into a reciprocating motion, a reciprocating motor compressor has a low frictional loss, and accordingly the reciprocating motor compressor is superior to a general compressor in the compressing efficiency aspect.

When the reciprocating compressor is used for a refrigerator or an air conditioner, a compression ratio of the reciprocating compressor is varied as varying a stroke voltage inputted to the reciprocating compressor, thereby controlling cooling capacity. A reciprocating compressor in accordance with the conventional art will now be described with reference to FIG. 1.

FIG. 1 is a block diagram showing a structure of an apparatus for controlling an operation of a reciprocating compressor in accordance with the conventional art.

As shown therein, the apparatus for controlling an operation of the reciprocating compressor includes: a voltage detecting unit 14 for detecting a voltage applied to the reciprocating compressor 13 according to the variation of a stroke of the reciprocating compressor; a current detecting unit 12 for detecting a current applied to the reciprocating compressor 13 according to the variation of the stroke; a microcomputer 15 for calculating a stroke based on a voltage value detected by the voltage detecting unit 14 and a current value detected by the current detecting unit 12, comparing the calculated stroke and a stroke reference value, and generating a switching control signal according to the comparison result; and a power supply unit 11 for supplying a stroke voltage to the reciprocating compressor 13 by on-off controlling the supply of AC power to the reciprocating motor compressor 13 with a triac Tr1 controlled by the switching control signal generated by the micro-computer 15. Herein, the reciprocating compressor 13 receives a stroke voltage supplied to an internal motor (not shown), varies a stroke according to a stroke reference value set by a user, and thereby vertically moves an internal piston (not shown).

Hereinafter, operations of the apparatus for controlling an operation of a reciprocating compressor in accordance with the present invention will now be described.

First, the reciprocating compressor 13 receives a voltage supplied to the internal motor, varies the stroke according to the stroke reference value, and moves the piston vertically according to the varied stroke. Herein, the stroke means a distance over which the piston inside the reciprocating compressor 13 moves while reciprocating.

A turn-on period of a triac (Tr1) of the power supply unit 11 is lengthened by a switching control signal outputted from the microcomputer 15, and the AC power is supplied to the reciprocating compressor 13 due to the lengthened turn-on period, so that the reciprocating compressor 31 is driven. At this time, the voltage detecting unit 14 and the current detecting unit 12 detect a voltage and a current which are applied to the reciprocating compressor 13, and output the detected voltage value and the detected current value, respectively.

The microcomputer 15 calculates the stroke based on the voltage value and the current value respectively detected by the voltage detecting unit 14 and the current detecting unit 12, compares the calculated stroke with the stroke reference value, and generates a switching control signal according to the comparison result. For example, if the calculated stroke is smaller than the stroke reference value, the microcomputer 15 outputs a switching control signal for lengthening a turn-on period of the triac Tr1 to the power supply unit 11, to increase a stroke value to be supplied to the reciprocating compressor 13.

On the other hand, if the calculated stroke is greater than the stroke reference value, the microcomputer 15 outputs a switching control signal for shortening a turn-on period of the triac (Tr1) to the power supply unit 11, to decrease a stroke voltage to be supplied to the reciprocating compressor 13.

A capacitor (C) that is connected to an internal motor of the reciprocating compressor 13 in series, countervails an inductance of a coil wound in the internal motor. That is, since an inductance of the coil is countervailed by the capacitor (C), sufficient stroke is generated even with a lower input voltage. However, when power is supplied to the internal motor of the reciprocating compressor at an initial stage, an overcurrent is generated, thereby causing a damage of the reciprocating compressor.

Hereinafter, a PTC thermistor (Positive Temperature Coefficient Thermistor) which is added to an apparatus for controlling an operation of a reciprocating compressor in accordance with the conventional art in order to prevent a damage of the reciprocating compressor will now be described with reference to FIG. 2.

FIG. 2 is a block diagram showing a PTC thermistor (Positive Temperature Coefficient Thermistor) which is applied to the apparatus for controlling an operation of a reciprocating compressor of FIG. 1

As shown therein, the PCT thermistor is connected to the capacitor (C) in parallel and cuts off an overcurrent generated when the reciprocating compressor 13 is initiated at an initial stage, thereby preventing a damage of the reciprocating compressor 13. For example, when the compressor 13 is initiated at an initial stage, the PTC thermistor cuts off an overcurrent applied to the internal motor of the compressor, thereby protecting the compressor 13 from being overloaded. Herein, the overcurrent means a current greater than a reference current value the inner motor (M) of the reciprocating compressor 13 allows.

In addition, when a resistance value of the PTC thermistor is increased by a current applied to the internal motor (M) of the reciprocating compressor 13, the PTC thermistor becomes off. Then, the current is applied to the internal motor only through the capacitor (C).

Hereinafter, a wave form of a stroke when the reciprocating compressor operates, will now be described with reference to FIG. 3.

FIG. 3 is a view showing a stroke wave form when a reciprocating compressor in accordance with the conventional art operates.

As shown therein, when power is applied to an internal motor (M) of the reciprocating compressor through the PTC thermistor at an initial stage, an overcurrent and a surge current are generated, and an overstroke (A) (a stroke more than a reference value) is generated by the surge current. That is, a piston and a discharge value collide with each other by the surge current, thereby causing a damage of the reciprocating compressor, and by this collision is increased a noise of the reciprocating compressor. Herein, the surge current means a maximum current of a current exceeding a reference current value the internal motor (M) allows. That is, overcurrent is mostly cut off through the PTC thermistor, but still the surge current is applied to the internal motor (M).

A reciprocating compressor in accordance with a different embodiment of the present invention is disclosed in U.S. Pat. No. 6,644,943 registered on Nov. 11 in 2003.

SUMMARY OF THE INVENTION

Therefore, an object of the present invention is to provide an apparatus for controlling an operation of a reciprocating compressor capable of improving operational efficiency of the reciprocating compressor, by reducing a surge current generated when power is applied to the reciprocating compressor at an initial stage and thus reducing an initial stroke of the reciprocating compressor.

Another object of the present invention is to provide an apparatus for controlling an operation of a reciprocating compressor including an inductance increasing device connected to a motor of the reciprocating compressor.

To achieve these and other advantages and in accordance with the purpose of the present invention, as embodied and broadly described herein, there is provided an apparatus for controlling an operation of a reciprocating compressor including: an overcurrent cutting-off device connected in parallel to a capacitor that countervails an inductance of a coil wound in a motor of the reciprocating compressor and for cutting off an overcurrent applied to the motor; and a surge current cutting-off device connected to the overcurrent cutting-off device in series and for cutting off a surge current applied to the motor by increasing an inductance at an initial stage.

To achieve these and other advantages and in accordance with the purpose of the present invention, as embodied and broadly described herein, there is provided an apparatus for controlling an operation of a reciprocating compressor including a capacitor that countervails an inductance of a coil wound in a motor of the reciprocating compressor for controlling cooling capacity, further including: an overcurrent cutting-off device connected to the capacitor in parallel and for cutting off an overcurrent generated when the reciprocating compressor is initiated at an initial stage; and a surge current cutting-off device connected to the overcurrent cutting-off device in series and for cutting off a surge current generated when the reciprocating compressor is initiated at an initial stage, by increasing an inductance.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 4:
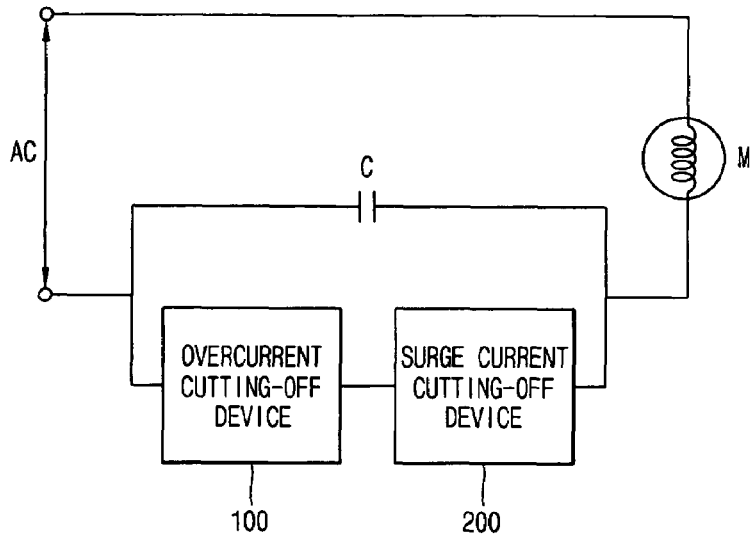
FIG. 4 is a block diagram showing a structure of an apparatus for controlling an operation of a reciprocating compressor in accordance with the present invention.

FIG. 4 is a block diagram showing a structure of an apparatus for controlling an operation of a reciprocating compressor in accordance with the present invention.

As shown therein, an apparatus for controlling an operation of a reciprocating compressor in accordance with the present invention. includes: a capacitor (C) for countervailing an inductance of a coil wound in an internal motor (M) of the reciprocating compressor; an overcurrent cutting-off device 100 connected to the capacitor (C) in parallel and for cutting off an overcurrent generated when power is applied to the internal motor (M) at an initial stage; and a surge current cutting-off device 200 connected to the overcurrent cutting-off device 100 in series and for cutting off a surge current generated when power is applied to the internal motor (M) at an initial stage, by increasing an inductance.

Herein, preferably, as the overcurrent cutting-off device 100, a PTC thermistor (Positive Temperature Coefficient Thermistor) that is turned-on when a current is applied to the internal motor (M) of the reciprocating compressor at an initial stage and is turn-off when its resistance value is increased as time elapses; or a relay which is turn-on to pass a current at an initial stage and cuts off a current by being turned off when predetermined time elapses is used.

Preferably, as the surge current cutting-off device 200, a reactor is used.

Figure 1:
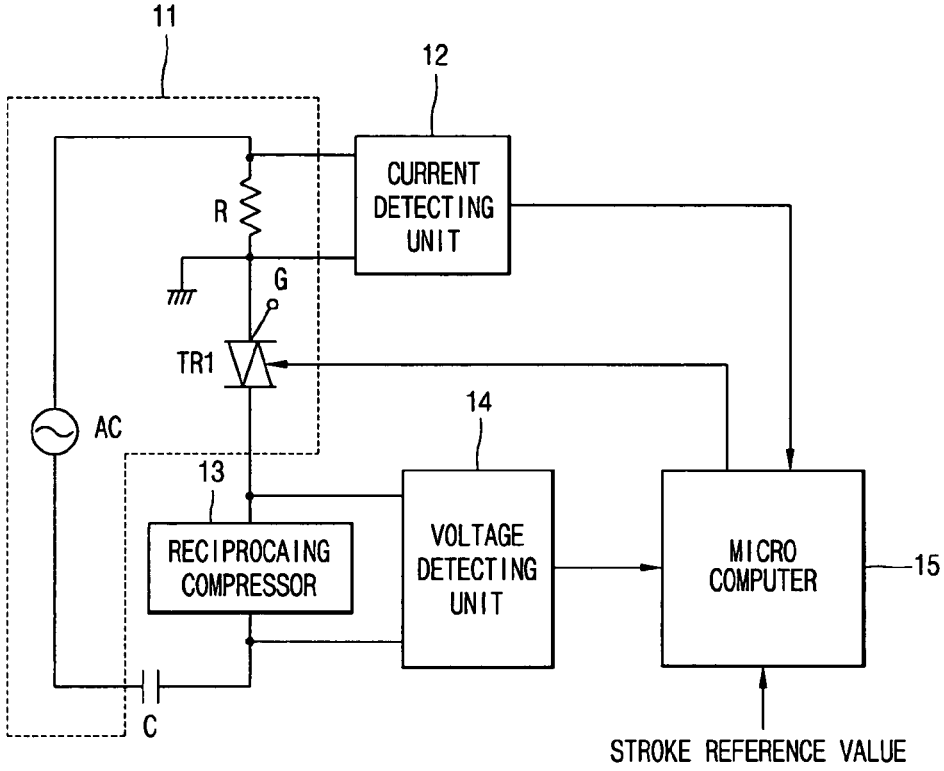
FIG. 1 PRIOR ART
FIG. 1 is a block diagram showing a structure of an apparatus for controlling an operation of a reciprocating compressor in accordance with the present invention.
Figure 2:
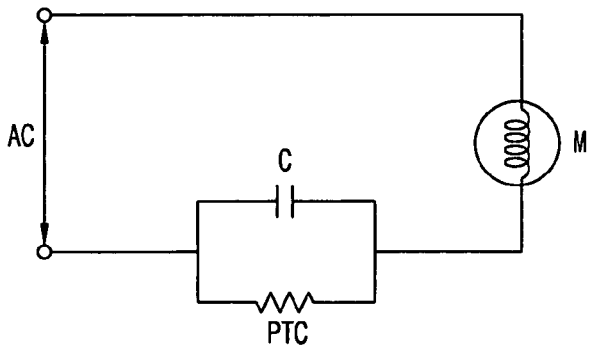
FIG. 2 PRIOR ART
FIG. 2 is a block diagram showing a PTC thermistor (Positive Temperature Coefficient Thermistor) applied to an apparatus for controlling an operation of a reciprocating compressor of FIG. 1.
Figure 3:
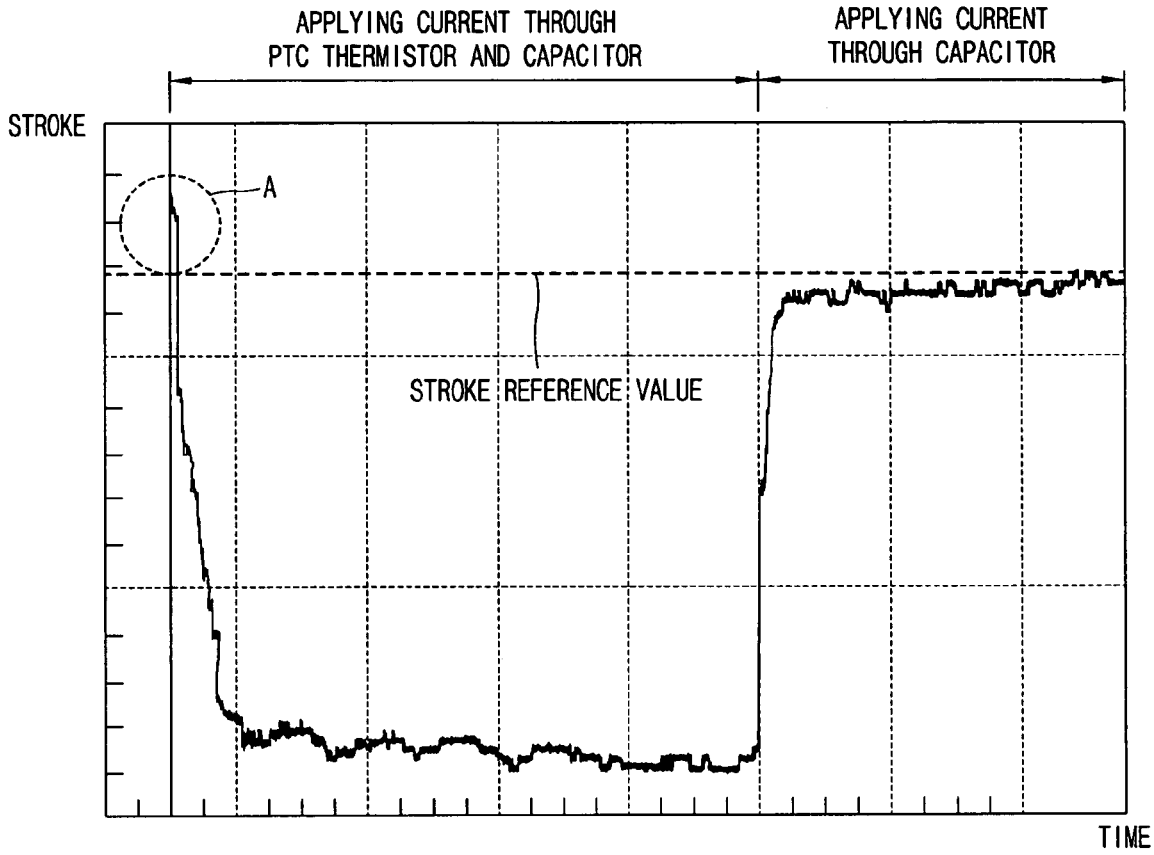
FIG. 3 PRIOR ART
FIG. 3 is a view showing a stroke wave form when a reciprocating compressor in accordance with the conventional art operates.

The apparatus for controlling an operation of a reciprocating compressor in accordance with the present invention may further include components of FIG. 1 (voltage detecting unit 14, current detecting unit 12, microcomputer, power supply unit). In order to avoid repetition of the components of FIG. 1, descriptions thereon will be omitted.

Hereinafter, operations of the apparatus for controlling an operation of a reciprocating compressor, which is additionally applied to the components of FIG. 1, in accordance with the present invention will now be described in detail.

First, when a stroke is varied by a voltage applied to an internal motor (M) of the reciprocating compressor, the capacitor (C) countervails an inductance of a coil wound in an internal motor (M) of the reciprocating compressor.

In addition, when power is applied to the internal motor (M) of the reciprocating compressor at an initial stage, a current is applied to the internal motor (M) through the overcurrent cutting-off device 100, the surge current cutting off device 200, and the capacitor (C). When an overcurrent is generated, the overcurrent cutting off device 100 is turned off to cut off a current applied to the internal motor. Herein, the overcurrent means a current which exceeds a reference current value the internal motor (M) allows.

When the overcurrent cutting-off device 100 is turned off, a current is applied to the internal motor through the capacitor (C) and thus the reciprocating compressor normally operates. Herein, in case of using a PTC thermistor as the overcurrent cutting-off device 100, the PTC thermistor is turned on at an initial stage to pass the current, and when its resistance value is increased by the current, the PTC thermistor cuts off current by being turned off. In addition, in case of using a relay as the overcurrent cutting-off device, the relay passes the current at an initial stage, and when a predetermined time elapses, it is turned off to cut off the current.

In case of using a reactor as the surge current cutting-off device 200, when power is applied to the internal motor at an initial stage, the reactor increases an inductance. That is, by increasing an inductance when power is applied to the internal motor (M) at an initial stage, the reactor cuts off a surge current generated when power is applied to the internal motor (M) of the reciprocating compressor through the PTC thermistor 100 at an initial stage. Herein, the surge current means a maximum current of a current, which exceeds a reference current value the internal motor (M) allows. Accordingly, by cutting off the surge current, a stable stroke wave form shown in FIG. 5 can be obtained.

Figure 5:
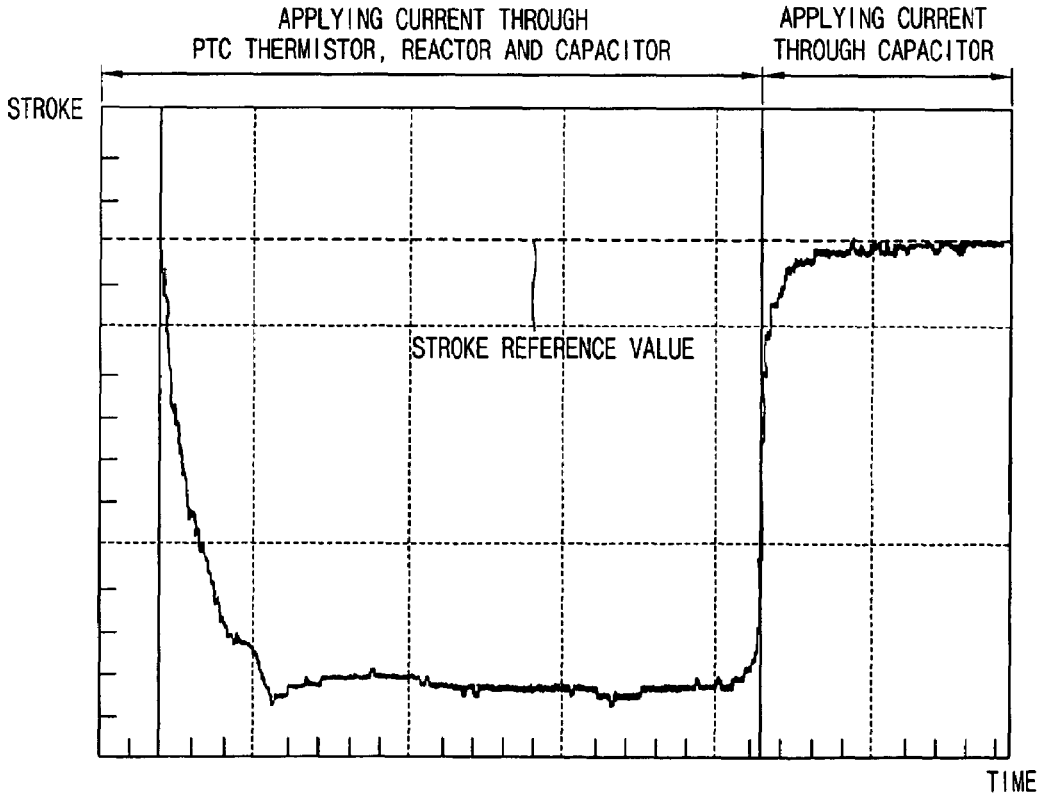
FIG. 5 is a view showing a stroke wave form when a reciprocating compressor in accordance with the present invention operates.

FIG. 5 is a view showing a stroke wave form when a reciprocating compressor in accordance with the present invention operates.

As shown therein, by increasing an inductance when power is applied to the internal motor (M) at an initial stage, a surge current generated when power is applied to the internal motor of the reciprocating compressor through the PTC thermistor 100 at an initial stage can be cut off. Also, by cutting off the surge current, an overstroke does not occur. That is, since a piston and a discharge valve do not collide with each other by cutting off the surge current, the reciprocating compressor is not damaged and a noise of the reciprocating compressor is reduced.

As so far described, an apparatus for controlling an operation of the reciprocating compressor in accordance with the present invention cuts off a surge current generated when the reciprocating compressor operates at an initial stage, so that damage of the reciprocating compressor can be prevented.

In addition, the apparatus for controlling an operation of the reciprocating compressor in accordance with the present invention cuts off a surge current when the reciprocating compressor operates at an initial stage, so that noise of the reciprocating compressor can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling an operation of a reciprocating compressor, the apparatus comprising:

a reactor connected to a motor of the reciprocating compressor and configured to cut off a surge current applied to the motor at an intial stage by increasing inductance; and an overcurrent cutting-off device connected in series to the reactor and configured to cut off an overcurrent applied to the motor, wherein the reactor and the overcurrent cutting-off device are connected in parallel to a capacitor that countervails an inductance of a coil wound in the motor of the reciprocating compressor.

2. An apparatus for controlling an operation of a reciprocating compressor comprising:

a voltage detecting unit for detecting a voltage applied to the reciprocating compressor according to the variation of a stroke of the reciprocating compressor;

a current detecting unit for detecting a current applied to the reciprocating compressor according to the variation of a stroke of the reciprocating compressor;

a microcomputer for calculating a stroke based on a voltage value detected by the voltage detecting unit and a current value detected by the current detecting unit, comparing the calculated stroke and a stroke reference value, and generating a switching control signal according to the comparison result;

a power supply unit for supplying a stroke voltage to the reciprocating compressor by on-off controlling AC power supplied to the reciprocating compressor with an internal triac controlled by the switching control signal generated by the microcomputer;

a relay configured to cut off an overcurrent applied to the motor; and a reactor configured to cut off a surge current which is applied to the motor at an initial stage, by increasing an inductance, wherein:

the relay is connected in series to the reactor; and the relay and the reactor are connected in parallel to a capacitor that countervails an inductance of a coil wound in a motor of the reciprocating compressor.

3. An apparatus for controlling an operation of a reciprocating compressor having a capacitor that countervails an inductance of a coil wound in a motor of the reciprocating compressor for controlling cooling capacity further comprising:

a positive temperature coefficient thermistor configured to cut off an overcurrent generated when the reciprocating compressor is initiated at an initial stage; and a reactor connected to the positive temperature coefficient thermistor in series configured to cut off a surge current generated when the reciprocating compressor is initiated at the initial stage, by increasing an inductance, wherein the positive temperature coefficient thermistor and the reactor are connected in parallel to the capacitor.

* * * * *

UNITED STATES PATENT AND TRADEMARK OFFICE

CERTIFICATE OF CORRECTION

PATENT NO. : 7,385,368 B2
APPLICATION NO. : 10/823596
DATED : June 10, 2008
INVENTOR(S) : Hong et al.

It is certified that error appears in the above-identified patent and that said Letters Patent is hereby corrected as shown below:

In the claims section, claim 1, column 6, line 6, in the printed patent, "intial" should be --initial--.

Signed and Sealed this

Thirteenth Day of January, 2009

JON W. DUDAS
*Director of the United States Patent and Trademark Office*